US007568933B2

(12) United States Patent
Shirai et al.

(10) Patent No.: US 7,568,933 B2
(45) Date of Patent: Aug. 4, 2009

(54) CONNECTOR FOR PROVIDING WATERPROOF CONNECTION AND METHOD OF EXAMINING ITS CONNECTION STATE

(75) Inventors: Yoshiaki Shirai, Saitama (JP); Yasuyuki Tachino, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 403 days.

(21) Appl. No.: 11/569,109

(22) PCT Filed: Feb. 22, 2006

(86) PCT No.: PCT/JP2006/303827

§ 371 (c)(1),
(2), (4) Date: Nov. 14, 2006

(87) PCT Pub. No.: WO2006/095607

PCT Pub. Date: Sep. 14, 2006

(65) Prior Publication Data

US 2008/0274635 A1 Nov. 6, 2008

(30) Foreign Application Priority Data

Mar. 10, 2005 (JP) ..... 2005-067697

(51) Int. Cl.
*H01R 13/52* (2006.01)

(52) U.S. Cl. ..... 439/271; 439/489; 439/955

(58) Field of Classification Search ..... 439/271, 439/489, 955

See application file for complete search history.

(56) References Cited

U.S. PATENT DOCUMENTS

| | | | | |
|---|---|---|---|---|
| 3,888,559 | A | 6/1975 | Geib | |
| 4,902,244 | A * | 2/1990 | Endo et al. | 439/489 |
| 5,336,104 | A | 8/1994 | Nagamine | |
| 5,556,287 | A * | 9/1996 | Kuhn et al. | 439/89 |
| 5,588,873 | A * | 12/1996 | Hamai et al. | 439/489 |
| 6,419,515 | B1 * | 7/2002 | Okayasu | 439/358 |
| 6,558,178 | B2 * | 5/2003 | Nakamura | 439/271 |
| 6,582,242 | B2 * | 6/2003 | Murakami et al. | 439/271 |

FOREIGN PATENT DOCUMENTS

| | | | |
|---|---|---|---|
| DE | 10225465 | C1 | 11/2003 |
| EP | 1235306 | A2 | 8/2002 |
| GB | 2361113 | A | 10/2001 |
| JP | 61-193277 | A | 8/1986 |
| JP | 2004-055236 | A | 2/2004 |

* cited by examiner

*Primary Examiner*—Hae Moon Hyeon
(74) *Attorney, Agent, or Firm*—Standley Law Group LLP

(57) ABSTRACT

A connector (10) having a waterproof function is provided which includes a female member (20) and a male member (40). The female member includes an inner tube portion (23) having a base part (26) having an outer peripheral surface covered with a sealing member (27). The female member includes an outer tube portion (22) having a peep window (28) formed therein such that the sealing member is visible. When coupling of the male member and the female member is complete, the sealing member is hidden by a tube (42) of the male member.

5 Claims, 6 Drawing Sheets

CONNECTOR FOR PROVIDING WATERPROOF CONNECTION AND METHOD OF EXAMINING ITS CONNECTION STATE

TECHNICAL FIELD

The present invention relates to a connector for use as an electrical component and, more particularly, to an improvement in a connector having a waterproof function.

BACKGROUND ART

A connector, as disclosed in JP-A-2004-055236, is usually used for connecting a harness and an electrical device.

FIG. 9A and FIG. 9B hereof each show an arrangement of the disclosed connector, designated at 100, including a male member 101 and a female member 104. FIG. 9A shows the connector 100 before the male member 101 is coupled to the female member 104. FIG. 9B shows the connector 100 with the male member 101 coupled to the female member 104.

The male member 101 has a resiliently deformable engagement piece 102 at an outer surface thereof. The engagement piece 102 has an outward projecting portion 103 formed at a distal end portion thereof.

The female member 104 has an engagement hole 105 formed in an outer surface thereof. The female member 104 has an open end portion having a sloped guide 106 formed at an inner surface thereof.

When the male member 101 is pushed into the female member 104, the projecting portion 103 of the male member 101 is depressed by the guide 106. The projecting portion 103 is then aligned with the engagement hole 105. Upon alignment with the engagement hole 105, the projecting portion 103 enters into the engagement hole 105 by its own resiliency. When the projecting portion 103 engages the engagement hole 105, coupling of the male member 101 and the female member 104 is complete.

In completing the coupling of the male member 101 and the female member 104, therefore, it is important to confirm that the projecting portion 103 engages the engagement hole 105. If such a confirmation is not neglected, the connector 100 would be used with insufficient engagement made between the projecting portion 103 and the engagement hole 105. If so, there is concern that the male member 101 is released from the female member 104 during use of the connector 100.

Conventionally, the engagement of the projecting portion 103 with the engagement hole 105 has been confirmed by confirming that sound is produced upon entry of the projecting portion 103 into the engagement hole 105 or by pulling both the male member 101 and the female member 104 in opposite directions away from each other.

However, the sound is difficult to distinguish from surrounding noise. Moreover, whether or not the production of the sound can be confirmed depends upon a sense of hearing of a user. Thus, the confirmation of the production of the sound provides less reliability. The pulling of the male member 101 and the female member 104 is not preferable because the pulling would cause mechanical damage to the male member 101 and the female member 104 or break harnesses.

There is desired an improved connector arranged such that coupling of a male member and a female member can be confirmed by a manner other than the confirmation of the production of the sound or the pulling operation.

DISCLOSURE OF THE INVENTION

According to a first aspect of the present invention, there is provided a connector having a waterproof function, comprising: a female member including an outer tube portion and an inner tube portion provided internally of the outer tube portion; a sealing member covering a base part of the inner tube portion; and a male member including a tube insertable between the outer tube portion and the inner tube portion to be coupled to the female member and compress the sealing member, wherein the outer tube portion has a peep window formed at a portion thereof corresponding to a region where the sealing member is provided, the peep window being not fully closed by the tube of the male member when coupling of the male member and the female member is incomplete, the peep window being fully closed by the tube when the coupling of the male member and the female member is complete.

Therefore, it is possible to judge that the coupling of the male member and the female member is incomplete when the sealing member is visible through the peep window. When the sealing member is invisible through the peep window, it is possible to judge that the coupling of the male member and the female member is complete. Thus, whether the coupling of the male member and the female member of the connector having the waterproof function is complete or incomplete can be visually judged. The coupling of the male member and the female member can be therefore confirmed even under noisy circumstance.

Preferably, the sealing member differs in color from the tube. By virtue of difference in color between the sealing member and the tube, whether the coupling of the male member and the female member is complete or incomplete can be quickly visually judged.

Preferably, the outer tube portion of the female member comprises an angular tube including a plurality of surfaces each having the peep window formed therein. It is thus possible to visually examine the coupling state of the male member and the female member from any side of the connector without contacting the connector or harnesses. This ensures that quality of the connector is maintained. The coupling of the male member and the female member can be visually confirmed with ease from any side of the connector, namely, it is possible to efficiently perform operation for examining the coupling state of the male member and the female member. Consequently, the number of steps necessary for the recognition of the coupling can be reduced.

According to a second aspect of the present invention, there is provided a method for examining a state of coupling of male and female members of a connector having a waterproof function, the method comprising the steps of: positioning a camera in such a manner that the camera faces at least a peep window of the connector, the connector comprising the female member including an outer tube portion and an inner tube portion provided internally of the outer tube portion, a sealing member covering a base part of the inner tube portion, and the male member including a tube insertable between the outer tube portion and the inner tube portion to be coupled to the female member and compress the sealing member, the sealing member differing in color from the tube, the outer tube portion having the peep window formed at a portion thereof corresponding to a region where the sealing member is provided, the peep window being not fully closed by the tube of the male member when the coupling of the male member and the female member is incomplete, the peep window being fully closed by the tube when the coupling of the male member and the female member is complete; binarizing an image taken by the camera; judging that the coupling of the male member and the female member is incomplete when binarized data provide two values; and judging that the coupling of the male member and the female member is complete when the binarized data provide only one value.

With this arrangement, the recognition of the coupling of the male member and the female member can be automated. The number of steps necessary for the recognition can thus be reduced.

Preferably, the outer tube portion of the female member comprises an angular tube including a plurality of surfaces each having the peep window formed therein, the camera being positioned in such a manner as to face the peep window formed in any one of the plurality of the surfaces.

BEST MODE FOR CARRYING OUT THE INVENTION

Figure 1:
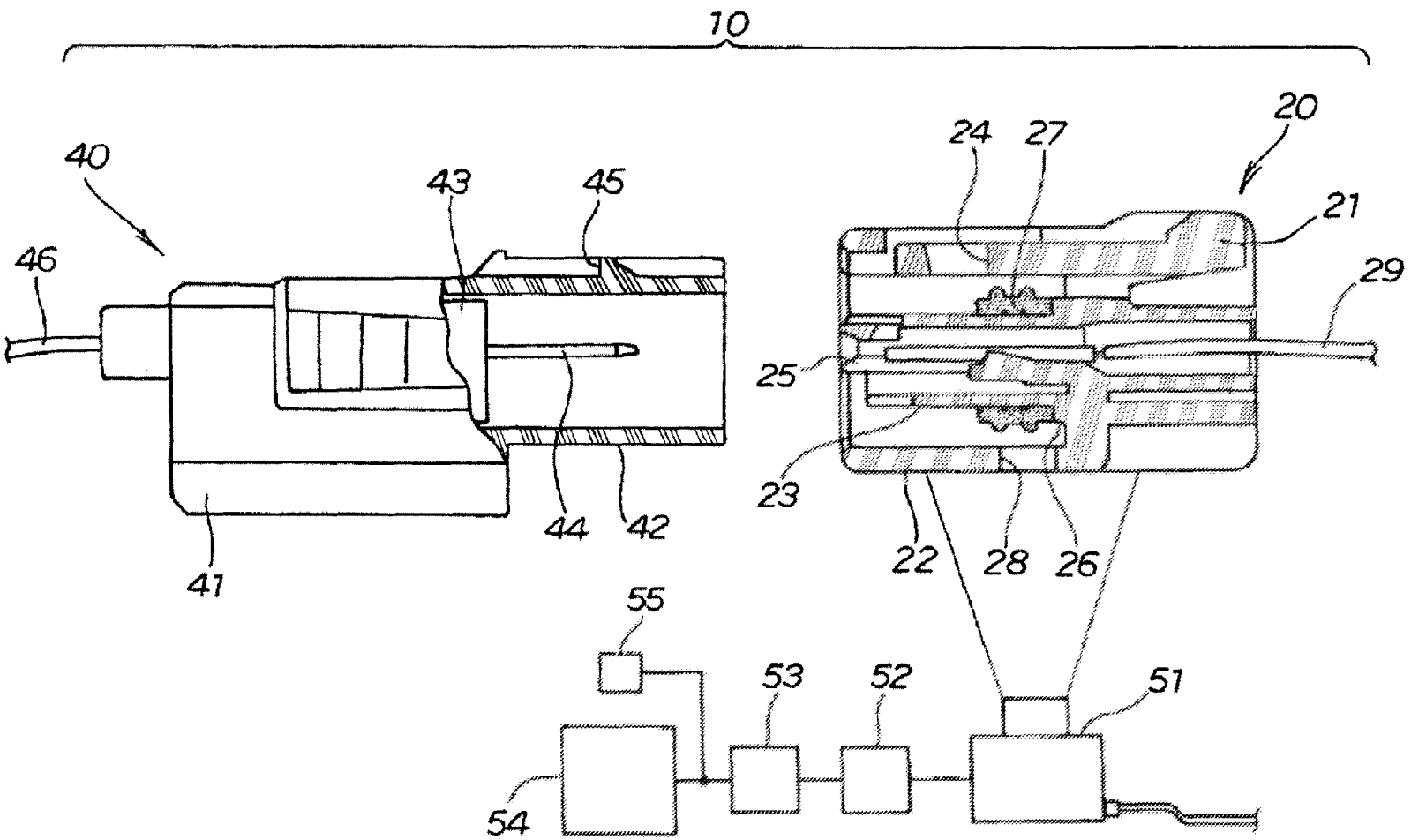
FIG. 1 is a cross-sectional view of a connector having a waterproof function, according to the present invention.

Referring now to FIG. 1, a connector 10 having a waterproof function, according to the present invention, includes a female member 20 and a male member 40.

The female member 20 has a proximal end portion 21, an outer tube portion 22 and an inner tube portion 23. The outer tube portion 22 and the inner tube portion 23 extend from the proximal end portion 21. The outer tube portion 22 and the inner tube portion 23 are formed integrally with each other. The outer tube portion 22 has a locking hole 24 formed therein. An electrode piece 25 is provided within the inner tube portion 23. The inner tube portion 23 has a base part 26 having an outer peripheral surface covered with a sealing member 27. The sealing member 27 exhibits a waterproof function when the female member 20 and the male member 40 are coupled to each other. The outer tube portion 22 has a peep window 28 formed therein such that the sealing member 27 is visible from outside the outer tube portion 22. Reference numeral 29 denotes a harness connected to the electrode piece 25.

The female member 20 is preferably molded from resin material having such a color as a black, dark blue, blue or brown color. The sealing member 27 is an elastic rubber having such a color as a white, yellow or brown color. The sealing member 27 has a selected color differing in tone from a color of the male member 40 as discussed later.

The sealing member 27 is preferably a rubber sealing member such as an O-ring. Alternatively, the sealing member 27 is a metal sealing member, such as a thin metal tube, or a silicone sealing member providing heat resisting function. In short, the sealing member 27 may be made from any material as long as the sealing member 27 is a resilient member exhibiting sealing function.

The male member 40 has a proximal end portion 41, a tube 42 extending from the proximal end portion 41, a housing 43 received within the tube 42, a pin 44 extending from the housing 43 towards the female member 20, and a locking piece 45 projecting from an outer peripheral surface of the tube 42. Reference numeral 46 denotes a harness connected to the pin 44.

The male member 40 is preferably made by molding a resin having such a color as a black, dark blue, blue or brown color. Where the male member 40 has a black color, the sealing member 27 preferably has a white, yellow or brown color. Where the male member 40 has a dark blue, blue or brown color, the sealing member 27 preferably has a white or yellow color.

Reference numerals 51, 52, 53, 54, 55 denote a camera, an image processing section, a normal/abnormal judging section, a display section, and an alarm emitting section, respectively.

Figure 2:
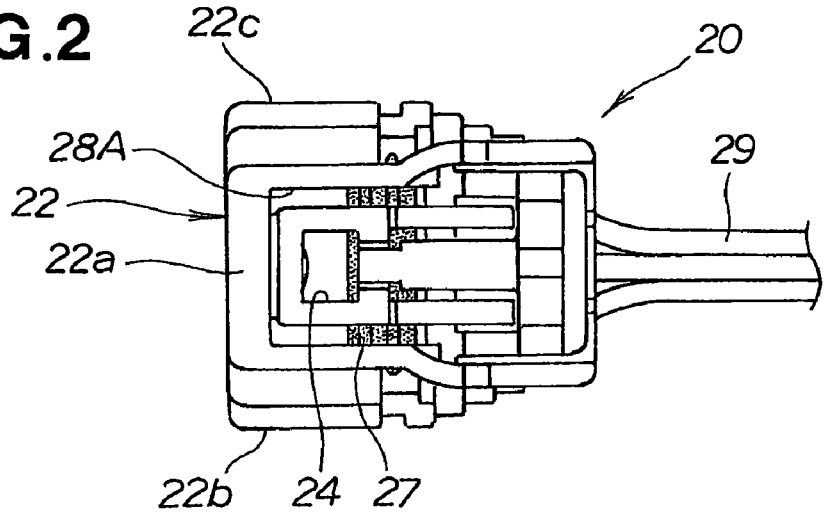
FIG. 2 is a plan view of a female member shown in FIG. 1.
Figure 3:
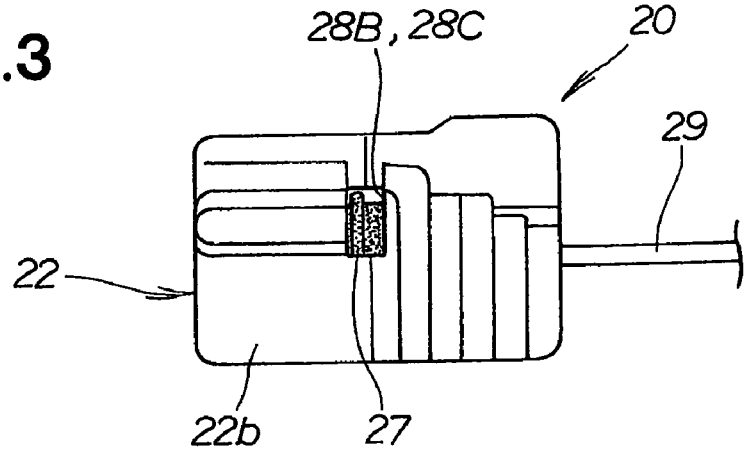
FIG. 3 is a side elevation view of the female member shown in FIG. 1.
Figure 4:
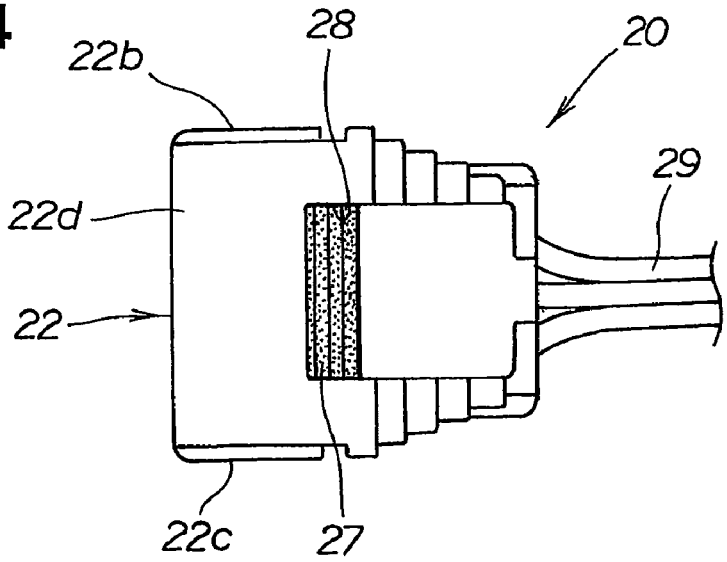
FIG. 4 is a bottom view of the female member shown in FIG. 1.

Next, structure of the female member 20 will be described with reference to FIG. 2 through FIG. 4.

The outer tube portion 22 of the female member 20 has an upper surface 22*a*, side surfaces 22*b*, 22*c* and a lower surface 22*d*. The upper surface 22*a* has a peep window 28A formed therein. The side surfaces 22*b*, 22*c* have peep windows 28B, 28C formed therein. The lower surface 22*d* has the peep window 28 formed therein. Through these peep windows 28A, 28B, 28C, 28, the sealing member 27 can be peeped.

Although each of the peep windows 28, 28A, 28B, 28C has a rectangular configuration in the illustrated embodiment, it may have a circular, oval, triangular or other configuration.

The peep windows 28, 28A, 28B, 28C preferably have as large sizes as possible from the standpoint of visibility of the sealing member 27. However, in order to maintain strength of the outer tube portion 22 of the female member 20, the sizes of the peep windows 28, 28A, 28B, 28C are preferably as small as possible. Thus, the sizes of the peep windows 28, 28A, 28B, 28C are preferably determined with both the visibility and the strength taken into account.

Figure 5:
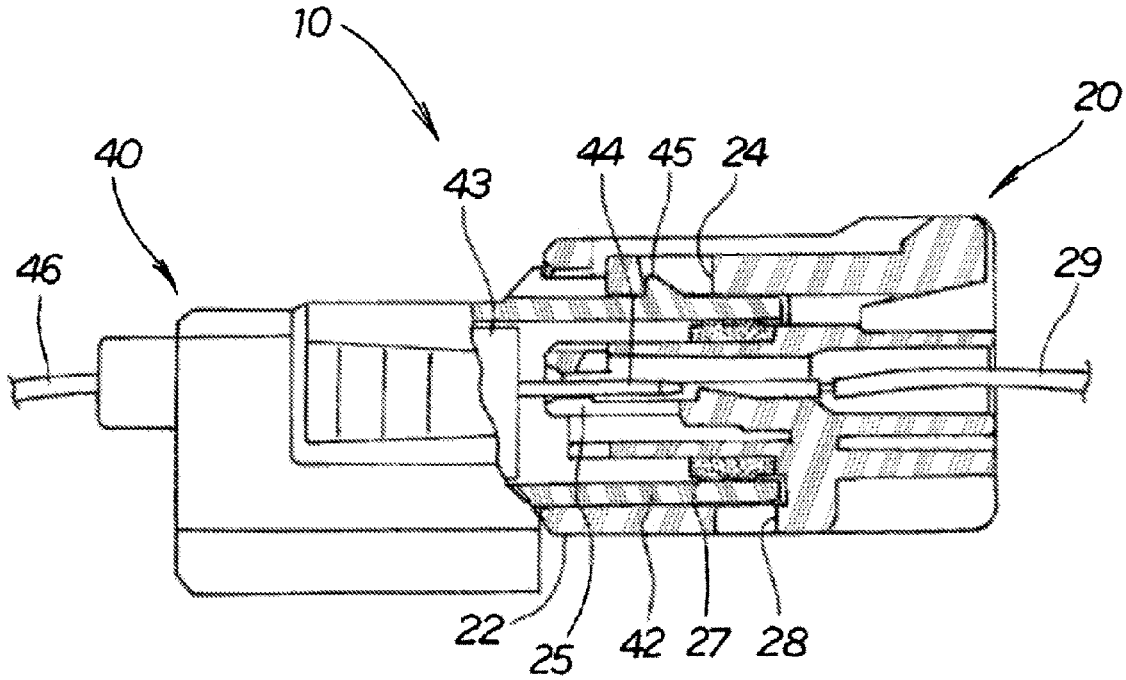
FIG. 5 is a view showing, partly in cross-section, a male member and the female member of FIG. 1 coupled to each other.
Figure 6:
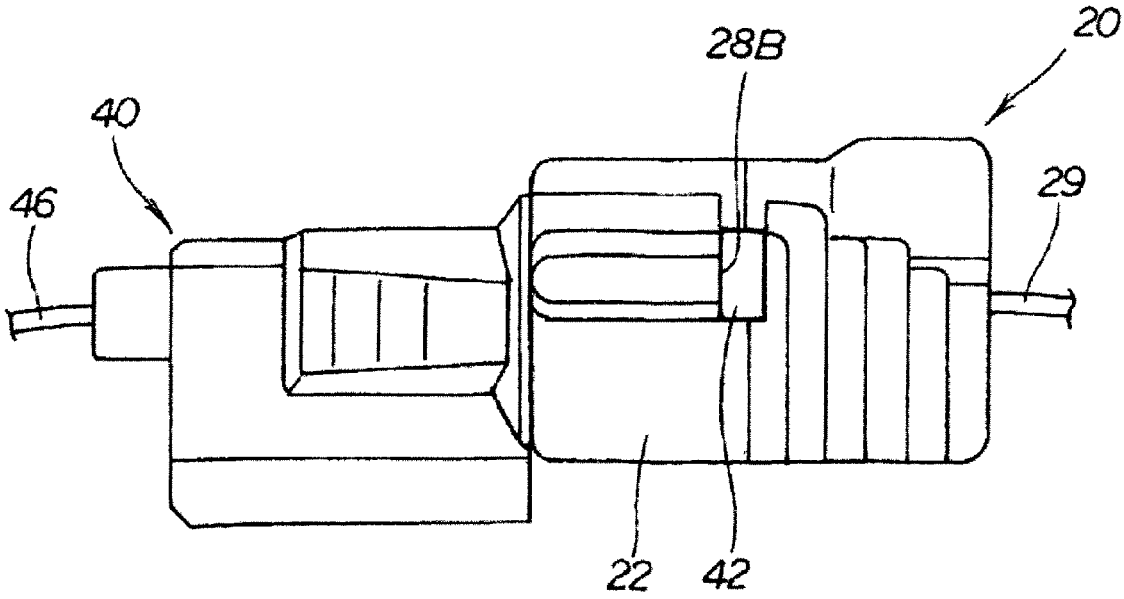
FIG. 6 is a side elevation view of the connector shown in FIG. 5.

FIG. 5 and FIG. 6 each show the female member 20 and the male member 40 coupled to each other.

With reference to FIG. 5, the pin 44 contacts the electrode piece 25. The locking piece 45 is in locking engagement with the locking hole 24. In this state, the tube 42 of the male member 40 has a distal end portion covering the sealing member 27 in such a manner as to compress the sealing member 27 for protecting the electrode piece 25 and the pin 44 from water.

In FIG. 6, the tube 42 is visible through the peep window 28B. Where the tube 42 of the male member 40 has a black color, the peep window 28B has an inside of black color. Where the coupling of the male member 40 and the female member 20 is incomplete and the tube 42 of the male member 40 does not arrive at a given position, the sealing member 27 is partly visible through the peep window 28B. If so, it is possible to examine or determine whether the coupling of the male member 40 and the female member 20 is insufficient or incomplete.

Next, binarization process will be explained with reference to FIG. 1 and FIG. 7A through FIG. 8B.

The camera 51 (FIG. 1) takes an image showing the peep window 28B centrally thereof. The image processing section 52 performs binarization process to blacken a dark color such as a black, dark blue, blue or brown color and to whiten a bright color such as a white or yellow color.

Figure 7A:
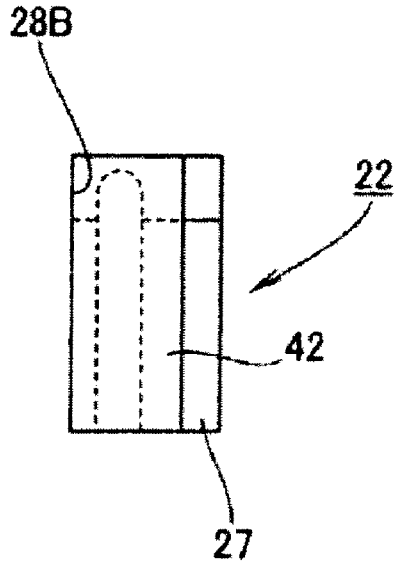
FIG. 7A and FIG. 7B are views each showing a peep window when coupling of the male member and the female member is incomplete.

FIG. 7A shows the peep window 28B when the coupling of the male member 40 and the female member 20 is incomplete. The camera 51 takes an image showing the tube 42 and the sealing member 27 which are visible through the peep window 28B.

Figure 7B:
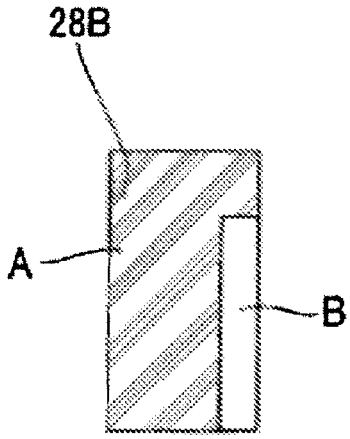

The image processing section 52 binarizes the image, obtained by the camera 51, to provide a black color A to the tube 42 within the peep window 28B and provide a white color B to the sealing member 27 within the peep window 28B, as shown in FIG. 7B.

The normal/abnormal judging section 53 (FIG. 1), when detecting the white color B of the sealing member 27, judges that the coupling of the male member 40 and the female member 20 is incomplete in which case the display section 54 displays information on a lot number etc. and the alarm emitting section 55 emits warning sound or warning light.

Figure 8A:
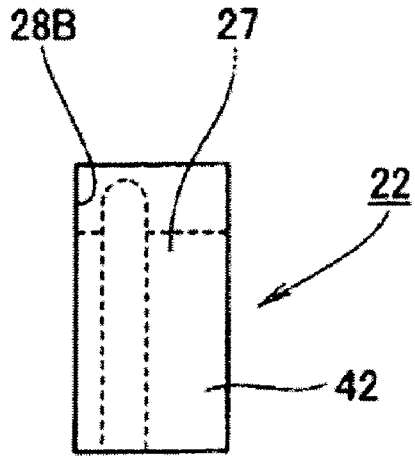
FIG. 8A and FIG. 8B are views each showing the peep window when the coupling of the male member and the female member is complete.
Figure 8B:
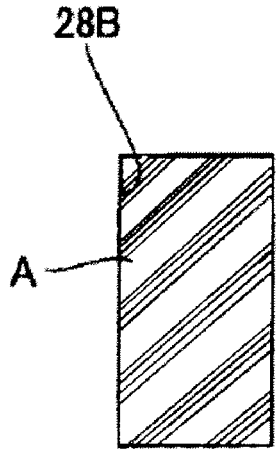
Figure 9A:
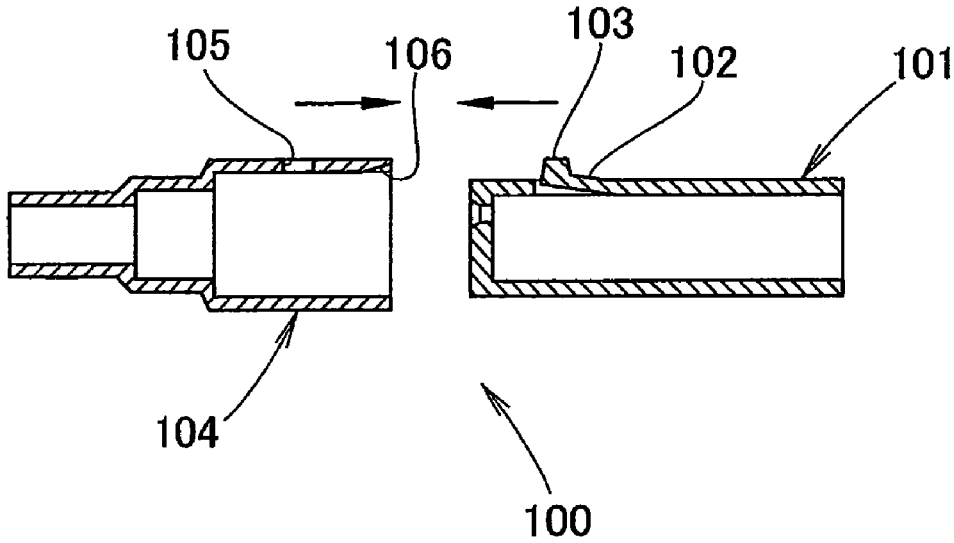
FIG.9A (PRIOR ART)
FIG. 9A and FIG. 9B are cross-sectional views of conventional connectors.
Figure 9B:
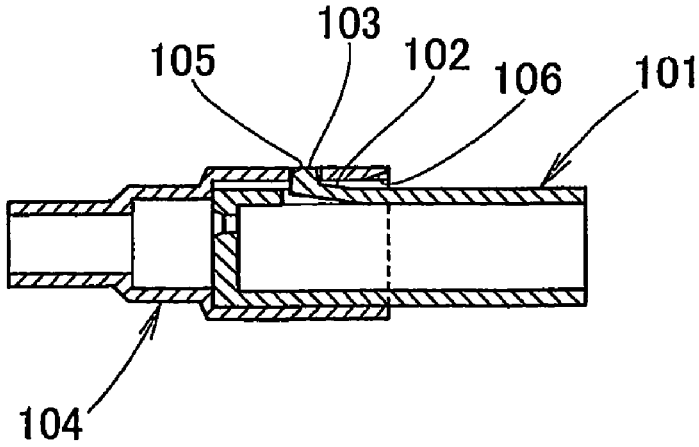
FIG.9B (PRIOR ART)

FIG. 8A shows the peep window 28B when the coupling of the male member 40 and the female member 20 is complete. The camera 51 takes an image showing the tube 42 alone visible through the peep window 28B.

The image processing section 52 binarizes the image, by which one value corresponding to a black color A of the tube 42 (shown in FIG. 8B) is obtained. Thus, the normal/abnormal judging section 53 judges that the coupling of the male member 40 and the female member 20 is complete.

When the camera 51 takes images of the peep windows 28, 28A through 28C and then two values corresponding to the black color A of the tube 42 and to the white color B of the sealing member 27 are obtained by the image processing section 52, the normal/abnormal judging section 53 judges that the coupling of the male member 40 and the female member 20 is incomplete.

In the illustrated embodiment, the camera 51 takes the image of the peep window 28B, as show in FIG. 7A through FIG. 8B. Alternatively, if the outer tube portion 22 having the peep window formed therein and the tube 42 of the male member 40 have the same color, for example, a black color, when the camera 51 takes an image of a region of the outer tube portion 22 including the peep window 28B and its surroundings, the image processing section 52 can perform the binarization process to blacken both the tube 42 and the outer tube portion 22. Positioning of the camera 51 for taking such an image of the region including the peep window 28B and its surroundings rather than an image of only the peep window 28B is facilitated.

When the peep windows 28, 28A through 28C have their insides fully covered with the tube 42, one value corresponding to a black color of both the tube 42 and the outer tube portion 22 is obtained by the image processing section 52. In this case, the normal/abnormal judging section 53 judges that the coupling of the male member 40 and the female member 20 is complete.

The above contents can be expressed as the following steps of:

using the camera 51 to take an image of a region including the peep window 28;

binarizing the image taken by the camera 51; and judging that the coupling of the male member 40 and the female member 20 is incomplete when two values are obtained from a result of binarization, or that the coupling of the male member 40 and the female member 20 is complete when one value is obtained from the result of the binarization.

The number of the peep windows is not limited as long as at least one peep window is provided. The outer tube portion 22 preferably has peep windows each provided in respective one of surfaces thereof, for example, the outer tube portion 22 has four peep windows where the outer tube portion 22 has four surfaces, or six peep windows where the outer tube portion 22 has six surfaces.

INDUSTRIAL APPLICABILITY

As discussed above, the present invention is suitable for a connector having a waterproof function, and in particular for examining the coupling state of male and female members of a connector used for releasably connecting a harness and an electrical device.

The invention claimed is:

1. A connector having a waterproof function, comprising:

a female member including an outer tube portion and an inner tube portion provided internally of the outer tube portion;

a sealing member located within the female member and covering a base part of the inner tube portion; and a male member including a tube insertable between the outer tube portion and the inner tube portion to be coupled to the female member and compress the sealing member, wherein the outer tube portion has a peep window formed at a portion thereof corresponding to a region where the sealing member is provided, the peep window being located with respect to the sealing member such that the sealing member becomes completely hidden from view through the peep window only upon full insertion of the male member into the female member.

2. The connector of claim 1, wherein the sealing member differs in color from the tube.

3. The connector of claim 1, wherein the outer tube portion of the female member comprises an angular tube including a plurality of surfaces each having the peep window formed therein.

4. A method for examining a state of coupling of male and female members of a connector having a waterproof function, the method comprising the steps of:

positioning a camera in such a manner that the camera faces at least a peep window of the connector, the connector comprising the female member including an outer tube portion and an inner tube portion provided internally of the outer tube portion, a sealing member located within the female member and covering a base part of the inner tube portion, and the male member including a tube insertable between the outer tube portion and the inner tube portion to be coupled to the female member and compress the sealing member, the sealing member differing in color from the tube, the outer tube portion having the peep window formed at a portion thereof corresponding to a region where the sealing member is provided, the peep window being located with respect to the sealing member such that the sealing member becomes completely hidden from view through the peep window only upon full insertion of the male member into the female member;

binarizing an image taken by the camera;

judging that the coupling of the male member and the female member is incomplete when binarized data provides two values; and judging that the coupling of the male member and the female member is complete when the binarized data provides only one value.

5. The method of claim 4, wherein the outer tube portion of the female member comprises an angular tube including a plurality of surfaces each having the peep window formed therein, the camera being positioned in such a manner as to face the peep window formed in any one of the surfaces.

* * * * *